US010002552B1

(12) United States Patent
Gologursky

(10) Patent No.: US 10,002,552 B1
(45) Date of Patent: Jun. 19, 2018

(54) LIGHT PANEL DISPLAY APPARATUS FOR IMAGE SHEET ILLUMINATION

(71) Applicant: Alex Gologursky, Boca Raton, FL (US)

(72) Inventor: Alex Gologursky, Boca Raton, FL (US)

( * ) Notice: Subject to any disclaimer, the term of this patent is extended or adjusted under 35 U.S.C. 154(b) by 176 days.

(21) Appl. No.: 14/217,177

(22) Filed: Mar. 17, 2014

Related U.S. Application Data

(60) Provisional application No. 61/802,453, filed on Mar. 16, 2013.

(51) Int. Cl.
*G09F 13/18* (2006.01)

(52) U.S. Cl.
CPC ..... *G09F 13/18* (2013.01)

(58) Field of Classification Search
CPC .... G02B 6/0091; G02B 6/006; G02B 6/0068; G02B 6/0021; G02B 6/0036; G02B 6/0025; G02B 6/0011; A47G 33/02
See application file for complete search history.

(56) References Cited

U.S. PATENT DOCUMENTS 5,215,285 A * 6/1993 Lewis ..... G09F 1/14 248/457
6,036,328 A * 3/2000 Ohtsuki ..... G02B 6/0021 362/582
6,082,880 A * 7/2000 Nerlino ..... A47G 33/02 362/121
6,341,440 B1 * 1/2002 Lee ..... G02B 6/0025 40/541
2002/0139023 A1 * 10/2002 Gianotti ..... G02B 6/0036 40/546
2010/0180479 A1 * 7/2010 Inaba ..... G02B 6/0036 40/546

* cited by examiner

*Primary Examiner* — Cassandra H Davis
(74) *Attorney, Agent, or Firm* — Oltman, Flynn & Kubler; Frank L. Kubler

(57) ABSTRACT

A light panel display apparatus includes an upright panel assembly with a translucent primary panel having a substantially smooth primacy panel first face and a primary panel second face with a series of light distributing grooves; a translucent diffusing panel, having substantially smooth diffusing panel inward face and substantially smooth a diffusing panel outward face, the diffusing panel being positioned substantially parallel and adjacent to with the primary panel second face; a translucent first image sheet having a first image and positioned substantially parallel and adjacent to the primary panel first face and a translucent second image sheet having a second image and being substantially parallel and adjacent to the diffusing panel outward face; and a base assembly comprising a generally horizontally extending base member with a panel assembly receiving slot into which the panel assembly is removably fitted so that the panel assembly is retained in, a lighting circuit including a light source positioned and oriented to radiate light into an edge of the panel assembly of sufficient intensity to illuminate the panel assembly, and an electric power source.

17 Claims, 4 Drawing Sheets

LIGHT PANEL DISPLAY APPARATUS FOR IMAGE SHEET ILLUMINATION

FILING HISTORY

This application continues from provisional patent application Ser. No. 61/802,453 filed on Mar. 16, 2013.

BACKGROUND OF THE INVENTION

1. Field of the Invention:

The present invention relates generally to the fields of advertising and decorating devices. More specifically the present invention relates to a light panel display apparatus such as for placement on a table top for displaying and illuminating a graphic image printed on an image sheet, and preferably for displaying and illuminating graphic images on opposing first and second image sheets. The apparatus includes an upright panel assembly and a base assembly into which the panel assembly is mounted, the panel assembly comprising a translucent primary panel having a substantially smooth primary panel first face and a primary panel second face with at least one light distributing groove, and a translucent diffusing panel having substantially smooth diffusing panel inward and outward faces, for placement parallel and adjacent to and preferably in abutting relation with the primary panel second face, a translucent first image sheet having a first image and being positioned substantially parallel and adjacent to, and preferably abutting the diffusing panel outward face, and preferably a translucent second image sheet having a second image and being positioned substantially parallel and adjacent to and preferably abutting the primary panel second face, and a cover sheet structure generally having an inverted U-shape with translucent first and second cover sheet sections extending over the first and second image sheets, respectively, and with a cover connecting portion, the panel assembly having a panel assembly upper end and a panel assembly lower end. The translucent primary panel diffusion panel and image sheets preferably are clear and transparent, with the exception of the images themselves.

The base assembly preferably includes a horizontally extending base member with an upwardly opening panel assembly receiving slot into which the panel assembly lower end is removably and engagingly fitted such that the panel assembly is retained by the base assembly in an upright position, a lighting circuit including an electric power source and a light source positioned and oriented to radiate light into a collective edge of the panel assembly of sufficient intensity to illuminate the panel assembly. The lower ends of the first and second cover sheet sections preferably each include a horizontal outwardly protruding engaging bulge for releasable snap engagement into corresponding slot interior recess preferably in the form of an engaging channel, such channels being provided in opposing longitudinal walls of the slot.

The lighting circuit preferably further includes an off/on switch, and the light source preferably is a series of light emitting diodes or LED's distributed along the lower surface of the panel assembly receiving slot and joined together as part of an LED bar. The base member preferably is hollow to define an internal chamber containing the lighting circuit, and the power source preferably includes a battery, but also could be a wall outlet for which a power cord with a plug is provided.

The base member preferably is a housing in the form of a plastic box defining a housing shell, and a conventional battery compartment box, an inwardly beveled housing front wall and an inwardly beveled housing back wall, both for mounting and displaying visible indicia such as for branding purposes, upright housing side walls, a housing top wall and upright slot walls bordering and defining the panel assembly receiving slot so that the slot has a depth sufficient to retain the LED bar and receive and securely mount the panel assembly lower end. The beveled housing front and rear walls, respectively, each preferably have a slightly recessed central area referred to herein as an indicia recessed region into which a sticker or plaque bearing indicia can be seated flush or below the level of the housing outer surface. The activating slide button of the on/off switch preferably is seated flush with the housing top wall upper surface within a switch recess in housing top wall, so that the on/off switch can be accessed and operated by a restaurant or bar owner such as with the tip of a flat head screw driver or other tool, but only with difficulty by customers inclined to turn the light source on or off against the wishes of the owner. The slot wall interior surface preferably angles outwardly as it progresses downwardly, so that the slot widens with depth and so that bulges resiliently cause the slot wall upper ends to bow apart as the lower end of panel assembly is inserted into the slot. Following panel assembly insertion, as the bulges reach the wider slot lower end, the slot wall upper ends snap back to their original linear shapes to retain the bulges and panel assembly lower end mounted in base assembly. Slot wall notches preferably are provided near opposing ends or the longitudinal segments of the slot wall to free the slot wall middle segment to more freely and resiliently flex outwardly as the panel assembly lower end and the bulges pass downwardly between the slot wall middle segments, whereupon as noted she slot wall middle segments resiliently snap back to their initial linear configurations and their resilience releasibly traps and retains the panel assembly lower end and bulges, to securely mount the panel assembly. The LED bar preferably rests within the slot and is secured with glue to the housing top wall lower surface surrounding slot within slot walls. A battery chamber box is secured to the lower surface of the housing top wall, preferably with 3M™ double-sided tape, and a light circuit wire extends downwardly through a wire port in the housing top wall from the LED bar to the on/off switch, and from there to the power source.

The at least one light distributing groove preferably is a light groove in the form of a score on the second face surface and preferably takes the form of a series of substantially horizontal such light distributing grooves extending generally from the lower end to the upper end of the primary panel second face for redistributing light intensity throughout the primary panel to more evenly illuminate the image sheets, so that there is not brighter light at the panel assembly lower end and dimmer light at the upper end. To more effectively achieve uniform light intensify redistribution, the grooves preferably become progressively closer together from the lower end to the upper end of the primary panel.

2. Description of the Prior Art:

There have long been lighted signs and other image illumination devices for advertising and other purposes. Various lighted displays have been developed for use on restaurant tables and on bars to advertise products, especially bottled water and beer. These devices have in some instances been a hollow light box containing a light bulb and having a front wall including a frosted panel onto which an advertising image sheet is secured. A more recent development has been a solid translucent panel illuminated by a light beamed into an edge of the panel and having an advertising image sheet secured over one or both outward faces. A problem with these display devices has been that the light intensity diminishes with distance from the light source so that the illuminated image is brightly lighted at the bottom and dimly lighted at the top.

Hillstrom, et al., U.S. Pat. No. 6,895,705, issued on May 24, 2005, discloses a light panel designed to solve the problem of progressively diminishing image illumination. Hillstrom, et al. provides an upright translucent panel illuminated by an upwardly directed light source below the panel edge. For one embodiment shown in FIG. 3B, one panel face has a series of horizontal grooves which become progressively closer together with increased distance from the light source. This arrangement of grooves can, when properly placed, redistribute the light intensity throughout the panel so that the intensity is substantially uniform from bottom to top. Nevertheless, while the problem of uniformity can be solved in this way, the solution leads to another problem. The grooves in the panel are visible through an image sheet placed over the grooved face of the panel and disrupt and distort the image. Therefore one is left to choose between displaying two opposing images with uneven light distribution or displaying one image with even light distribution.

Lerner, U.S. Pat. No. 5,433,024, issued on Jul. 18, 1995, teaches an edge-lighted display including an illuminated panel for displaying images on its two panel faces, the panel tapering in thickness from bottom to top. Image illuminating light sources, described as incandescent lamps, fit into a series of openings along the bottom edge of the panel.

Yeh, U.S. Patent Application Publication Number 2004/0118026, published on Jun. 24, 2004, reveals a side-beam reflecting billboard structure. Yeh includes a solid acrylic board having a light source along one edge of the hoard and a text or graphic image on one face, the board containing a reflecting panel with guiding ink which cross-crosses the board interior for distributing light throughout the board. Yeh is a relatively bulky and expensive structure to manufacture.

Tuite, et al., U.S. Patent Application Publication Number 2009/0323315, published on Dec. 31, 2009, discloses what is termed an illuminated table tent. Tuite, et al. includes a translucent tubular display sheet containing a co-axially extending tubular light refractor surrounded by a tubular light diffuser. Tuite, et al., is simply another version of the dated, bulky light box design.

Ashall, U.S. Pat. No. 5,625,968, issued on May 6, 1997, teaches a display system including transparent opposing surfaces and a light source at one edge for illuminating both surfaces. Each of the surfaces is provided with a matrix of dots arranged to permit interaction of the light between the surfaces to evenly distribute light throughout the surfaces and thus evenly illuminate a graphic image on one of the surfaces. Ashall appears to be complex and expensive to manufacture, and applicant questions the effectiveness of the matrix of dots.

Konomi, U.S. Patent Application Publication Number 2001/0022721, published on Sep. 20, 2001, reveals a double sided edge lighting-type display light box. Again, a bulky box device is provided with a light directing panel and two fluorescent bulbs contained within the box along opposing box edges for illuminating front and rear translucent box panels on which indicia are provided.

Lu, U.S. Pat. No. 7,278,770, issued on Oct. 9, 2007, discloses a double-sided light box. Lu includes two opposing image display surfaces, a rectangular frame having wiring ducts, four upper and lower lids, and a spring blade. Thus Lu revisits and perhaps updates the old bulky and expensive light box design.

Akiyama, U.S. Pat. No. 8,049,850, issued on Nov. 1, 2011, teaches a double-sided display apparatus. Akiyama includes two display panels where one panel is positioned on top of the other panel and each having two transparent substrates disposed opposite each other with a liquid crystal layer disposed between them. Akiyama is thus complex, bulky and relative expensive to manufacture.

Dunn, U.S. Pat. No. 7,942,542, issued on May 17, 2011, reveals a back lighted replaceable image sheet display apparatus. Dunn includes a light guide plate and a replaceable image sheet placed over the guide plate which is intended to provide uniform illumination, guide plate preferably being retained within a frame, all of which are illuminated with light emitting diodes.

It is thus an object of the present invention to provide a display apparatus which illuminates at least one and preferably two opposing images on image sheets and distributes light intensity uniformly across both images so that the images are clearly visible without distortion.

It more specifically an object of the present invention to provide a display apparatus which includes an upright translucent primary panel having a generally smooth first face and having a second face with at least one light distributing groove for distributing light evenly through the panel with generally uniform intensity, and a light source delivering light into an edge of the primary panel, a diffusion panel positioned over the second face to diffuse the visual impression of the groove, and a first image sheet with a first image positioned over the primary panel first face and a second image sheet with a second image positioned over the primary panel second face such that the diffusion panel prevents cluttering and distortion of the second image, such that both the first and second images are displayed simultaneously with uniform intensity of light throughout each image, so that the capability of the apparatus is thereby effectively doubling through displaying two opposing images rather than just one.

It is another object of the present invention to provide such an apparatus including a cover sheet structure fitting around and thereby holding the primary panel, the diffusing panel and the first and second image sheet upper ends together to prevent them from bowing and fanning apart.

It is still another object of the present invention to provide such a display apparatus which is readily hand portable.

It is finally an object of the present invention to provide which a display apparatus which is easy to understand and use, is attractive, durable and relatively inexpensive to manufacture.

SUMMARY OF THE INVENTION

The present invention accomplishes the above-stated objectives, as well as others, as may be determined by a fair reading and interpretation of the entire specification.

A light panel display apparatus is provided m the form of an upright panel assembly including a translucent primary panel having a substantially smooth primary panel first face and a primary panel second face with at least one light distributing irregularity; a translucent diffusing panel, having substantially smooth diffusing panel inward face and substantially smooth a diffusing panel outward face, the diffusing panel being positioned substantially parallel and adjacent to with the primary panel second face; a translucent first image sheet having a first image and positioned substantially parallel and adjacent to the primary panel first face and a translucent second image sheet having a second image and being substantially parallel and adjacent to the diffusing panel outward face; and a base assembly comprising a generally horizontally extending base member with a panel assembly receiving slot into which the panel assembly is removably fitted so that the panel assembly is retained in, a lighting circuit including a light source positioned and oriented to radiate light into art edge of the panel assembly of sufficient intensity to illuminate the panel assembly, and an electric power source.

The apparatus preferably additionally includes a cover sheet structure for structurally holding together the upper ends of the primary panel, diffusing panel and image sheets so that gravity does not bow and fan them apart over time and for protecting the image sheets from mechanical damage and staining, the cover sheet structure including a generally inverted U-shape with a translucent first cover sheet extending over the first image sheet and a translucent second cover sheet section extending over the second image sheet, and a cover sheet connecting portion, the panel assembly having a panel assembly upper end and a panel assembly lower end. The slot preferably includes an internal engaging recess and the at least one cover sheet section preferably includes an outwardly protruding engaging bulge for releasable snap engagement into the engaging recess to releasably secure the panel assembly into the panel assembly receiving slot. The lighting circuit preferably additionally includes an off/on switch. The light source preferably includes a series of light emitting diodes distributed within the panel assembly receiving slot and joined together as part of a light emitting diode bar.

The base member preferably is hollow to define an internal chamber containing the lighting circuit, and the power source comprises a battery. The base member preferably includes a housing having a housing bottom wall with a battery access door, an inwardly beveled housing front wall and an inwardly beveled housing back wall, both for mounting and displaying visible indicia, upright housing side walls, a housing top wall and upright slot walls bordering and defining the panel assembly receiving slot so that the assembly receiving slot has a depth sufficient to retain the light emitting diode bar and also receive and securely mount the panel assembly lower end.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
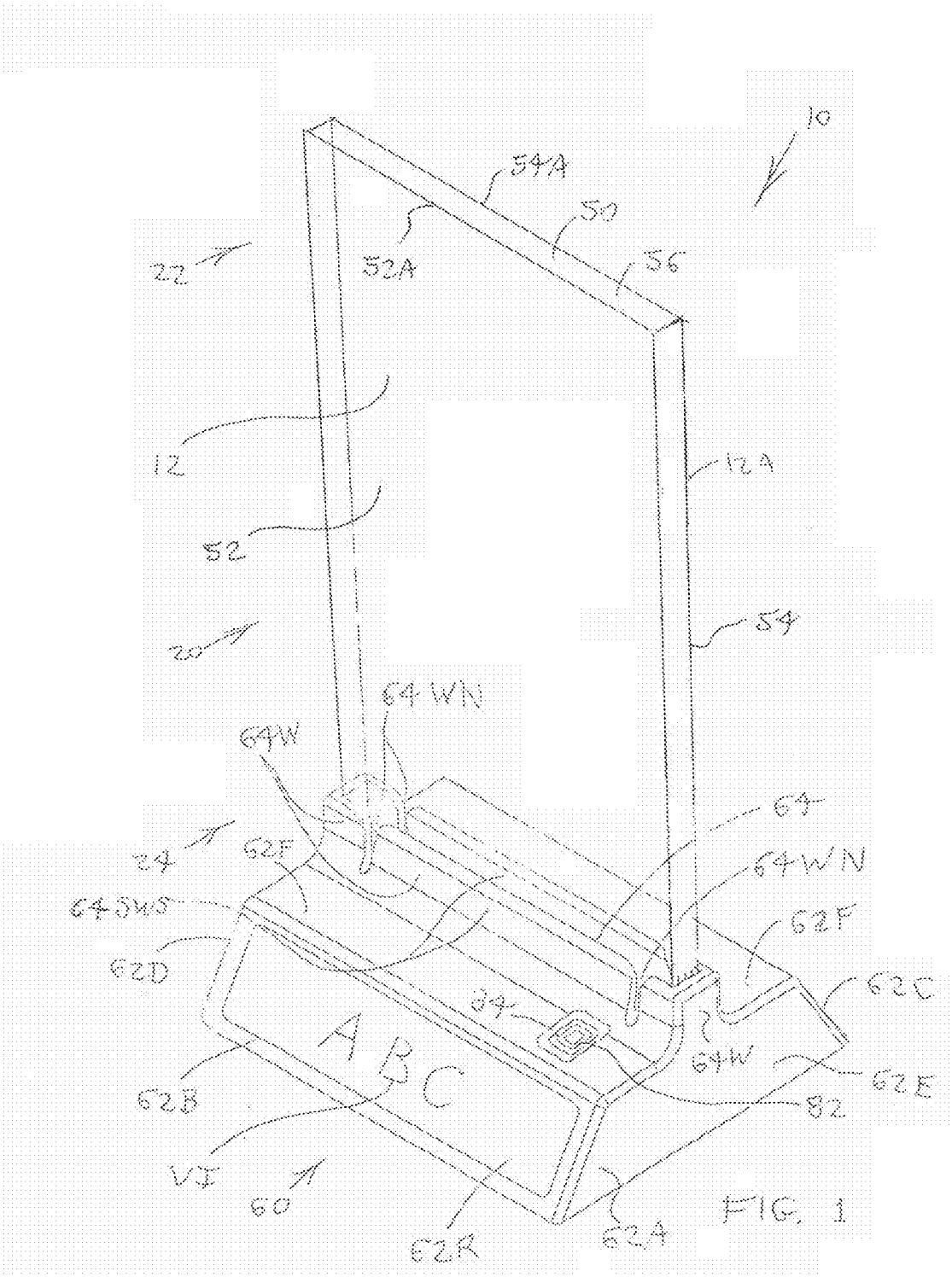
FIG. 1 is a perspective front view of the assembled display apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
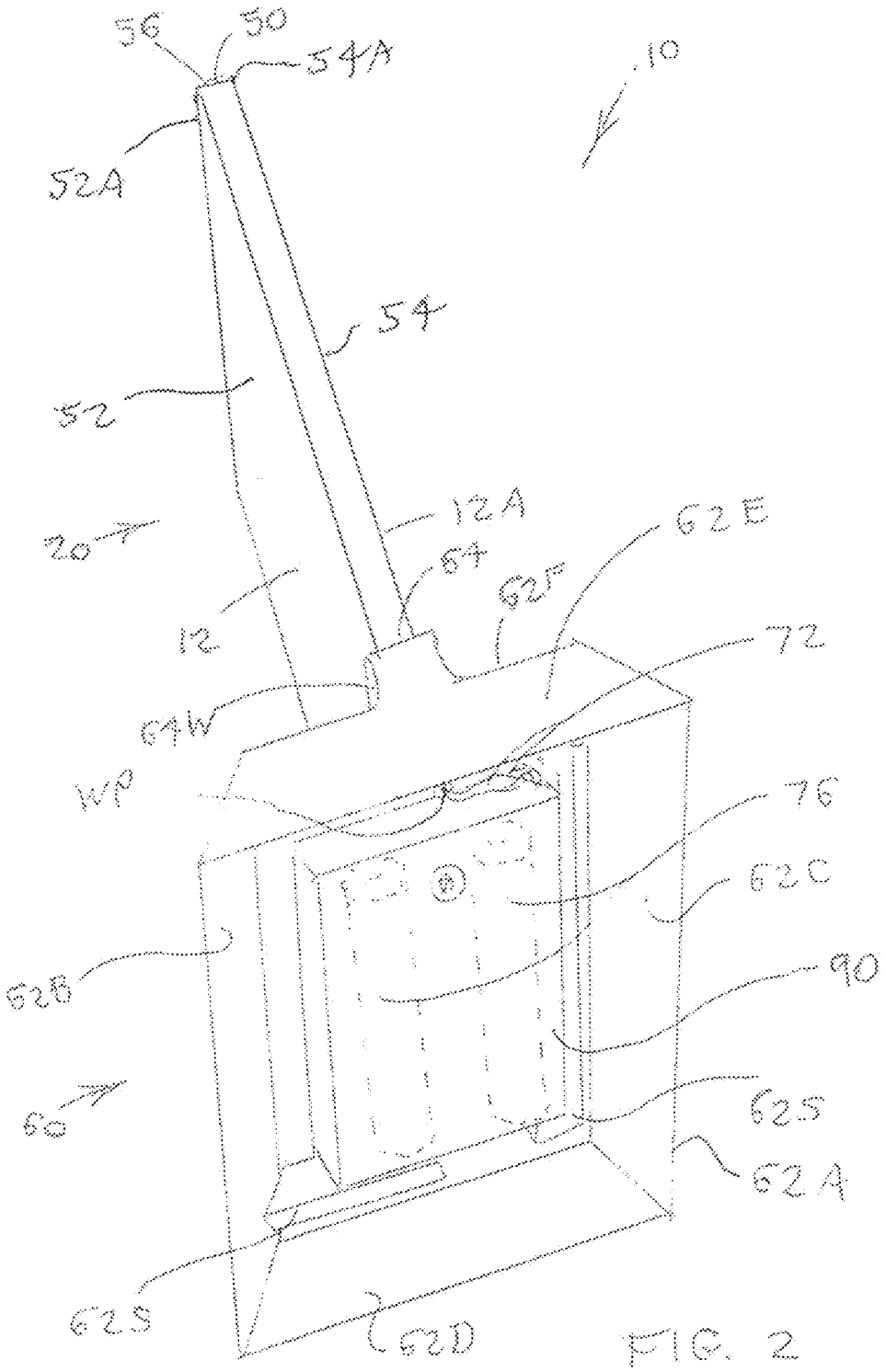
FIG. 2 is a perspective bottom view of the apparatus of FIG. 1.
Figure 3:
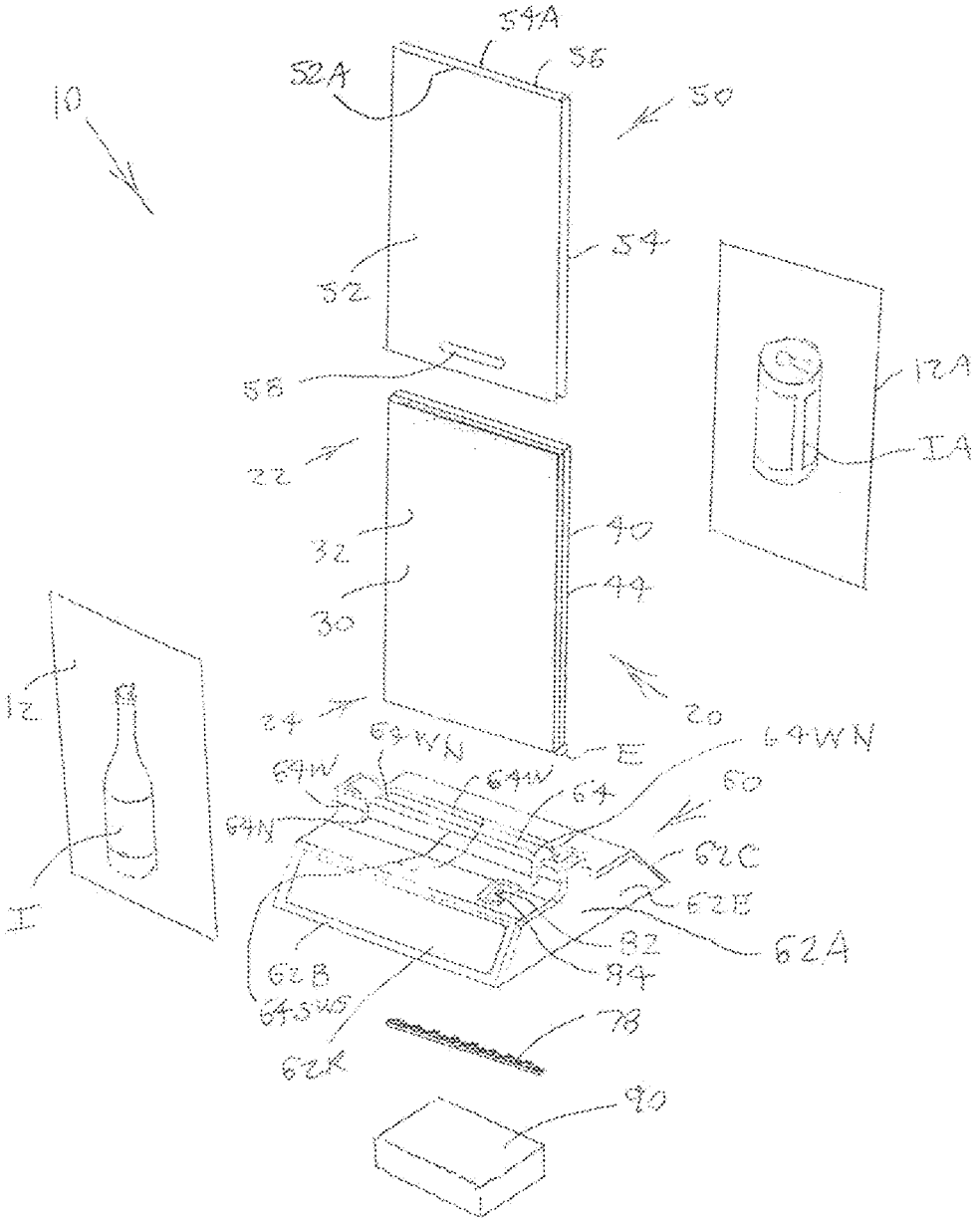
FIG. 3 is an exploded view of the panel assembly, cover structure, image sheets and the base assembly of FIG. 1.
Figure 4:
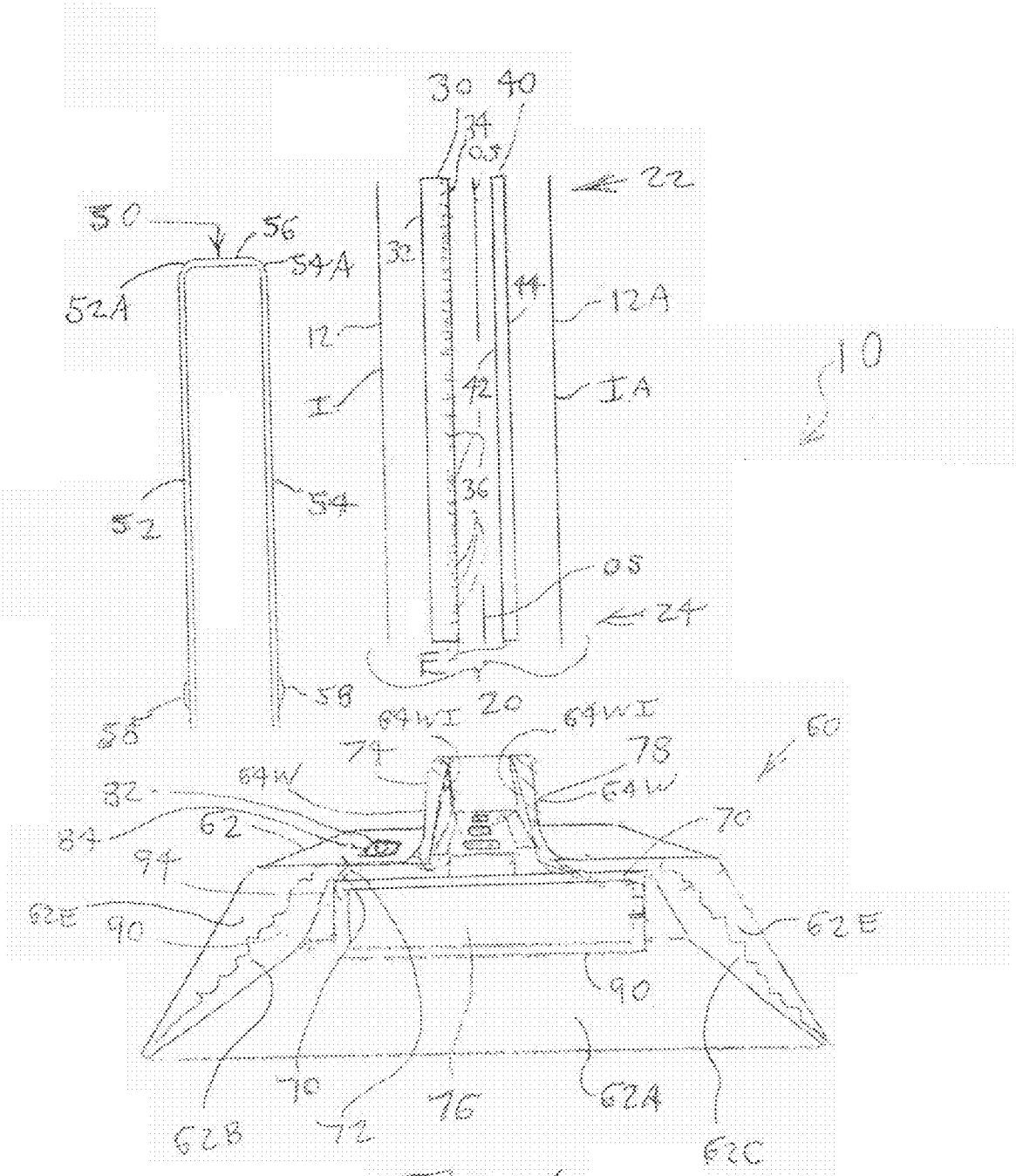
FIG. 4 is an exploded view of the display apparatus of FIG. 1 with the forward base side wall broken away to reveal the battery compartment box, LED bar and downwardly expanding slot interior.

Referring to FIGS. 1-4, a light panel display apparatus 10 is disclosed such as for placement on a table top for displaying and illuminating a graphic image I printed on an image sheet 12, and preferably for displaying and illuminating graphic images I and IA on opposing first and second image sheets 12 and 12A.

The apparatus 10 includes an upright panel assembly 20 and a base assembly 60 into which the panel assembly 20 is mounted, the panel assembly 20 comprising a translucent primary panel 30 having a substantially smooth primary panel first face 32 and a primary panel second face 34 with at least one light distributing groove 36, a translucent diffusing panel 40, having a smooth diffusing panel inward face 42 and a smooth diffusing panel outward face 44, for placement parallel and adjacent to, and preferably in abutting relation with the grooved primary panel second face 34, a translucent first image sheet 12 having a first image I and being substantially parallel and adjacent to and preferably abutting the primary panel first face 32, and a translucent second image sheet 12A having a second image IA and being substantially parallel and adjacent to and preferably abutting the diffusing panel outward face 44, and a cover sheet structure 50 generally having an inverted U-shape with translucent first and second cover sheet sections 52 and 54 extending over first and second image sheets 12 and 12A, respectively, and with a cover connecting portion 56. The cover connecting portion 56 is connected to the first cover sheet section 52 at a first corner fold 52A, and is connected to the second cover sheet section 54 at a second corner fold 54A. See FIG. 4. An opaque sheet OS or film optionally is placed between the primary panel second face 34 and the diffusion panel 40. The opaque sheet OS serves to help diffuse the shadows of the engraved light distributing lines or grooves 36, and alternatively services to permit the use of a printed graphic image I on clear film, as opposed to a print on white film and which diffuses itself. This is helpful because when the printing is on clear film, the lines and acrylic are seen as well as the opposing image I or IA. This method may also create a depth effect so that the image I or IA appears three-dimensional, or an illusion of depth as the printed image may be floating. The panel assembly 20 has a panel assembly upper end 22 and a panel assembly lower end 24.

The base assembly 60 preferably comprises a horizontally extending base member 62 with an upwardly opening panel assembly receiving slot 64 into which the panel assembly lower end 24 is removably and engagingly fitted such that the panel assembly 20 is retained by base assembly 60 in an upright, preferably vertical position, a lighting circuit 70 including circuit wiring 72, a light source 74 positioned and oriented to radiate light into a collective edge E of the panel assembly 60 and of sufficient intensity to fully illuminate the panel assembly 20, and includes an electric power source 76.

The lower ends of cover sheet sections 52 and 54 preferably each include a horizontal outwardly protruding engaging bulge 58 for releasable snap engagement into corresponding engaging interior recess preferably in the form of an engaging slot channel SC, such channels SC being provided in opposing longitudinal walls of slot 64.

The lighting circuit 70 preferably further includes an off/on switch 82, and the light source 74 preferably is a series of upwardly directed light emitting diodes or LED's distributed along the lower surface of the panel assembly receiving slot 64 and joined together as part of an LED bar 78 to distribute light along the lower panel assembly edge E. The base member 62 preferably is hollow to define an base member chamber 90 containing the lighting circuit 70, and the power source 76 preferably includes a battery such as a standard AA battery. The power source 76 alternatively could be a conventional building wall outlet (not shown) for which the lighting circuit 70 would include a power cord with plug (not shown).

The base member 62 preferably is a housing in the form of a plastic box defining a housing shell 62A, and a conventional battery compartment box 62AB, an inwardly beveled housing front wall 62B and an inwardly beveled housing back wall 62C both for mounting and displaying visible indicia VI such as for branding purposes, upright housing side walls 62D and 62E, a housing top wall 62F and upright slot walls 64W bordering and defining the panel assembly receiving slot 64 so that the slot 64 has a depth sufficient to retain the LED bar 78 and receive and securely mount the panel assembly lower end 24. The beveled housing front and rear walls 62B and 62C, respectively, each preferably have a slightly recessed central area referred to herein as an indicia recessed region 62R into which a sticker or plaque bearing indicia VI can be seated flush or below the level of the housing 62 outer surface. The activating slide button of the on/off switch 82 preferably is seated flush with the housing top wall 62F upper surface within a switch recess 84 in housing top wall 62F, so that the on/off switch 82 can be accessed and operated by a restaurant or bar owner such as with the tip of a flat head screw driver or other tool, but only with difficulty by customers inclined to turn the light source 74 on or off against the wishes of the owner. See FIG. 4. The slot wall interior surface 64WI preferably angles outwardly as it progresses downwardly, so that the slot 64 widens with depth and so that bulges 58 resiliently cause the slot wall 64SW upper ends to bow apart as the lower end of panel assembly 20 is inserted into the slot 64. Following panel assembly 20 insertion, as the bulges 58 reach the wider slot 64 lower end, the slot wall 64SW upper ends snap back to their original linear shapes to retain the bulges 58 and panel assembly 20 lower end mounted in base assembly 60. Slot wall notches 64WN preferably are provided near opposing ends of the longitudinal segments of the slot wall 64W to free the slot wall middle segment 64SWS to more freely and resiliently flex outwardly as the panel assembly 20 lower end and the bulges 58 pass downwardly between the slot wall middle segments 64SWS, whereupon as noted the slot wall middle segments 64SWS resiliently snap back to their initial linear configurations and their resilience releasibly traps and retains the panel assembly 20 lower end and bulges 58, to securely mount the panel assembly 20. The LED bar 78 preferably rests within the slot 64 and is secured with glue G to the housing top wall 62F lower surface surrounding slot 64 within slot walls 64A. A battery chamber box 90 is secured to the lower surface of the housing top wall 62F, preferably with 3M™ double-sided tape, and a light circuit wire 72 extends downwardly through a wire port WP in the housing ton wall 62F from the LED bar 78 to the on/off switch 78, and from there to the power source 76.

The at least one distributing groove 36 preferably is a light groove in the form of a score on the surface of the primary panel second face 34 and preferably takes the form of a series of substantially horizontal such light distributing grooves 36 extending generally from the lower end to the upper end of the primary panel second face 34 for redistributing light intensity throughout the primary panel to more evenly illuminate the primary panel 30 and the image sheets 12 and 12A, so that there is not brighter light at the panel 30 lower end and dimmer light at the panel 30 upper end. To more effectively achieve uniform light intensity redistribution, the grooves 36 preferably become progressively closer together from the lower end to the upper end of the primary panel 30. The depth of each groove 36 preferably is shallow, such as a score caused by a laser on level one. The preferred minimum primary panel 30 thickness is three sixteenths of an inch, and the minimum primary panel 30 thickness needed to produce satisfactory image illumination results has been found to be substantially one-sixteenth of an inch. The preferred minimum diffusion panel 40 thickness is one eighth inch, and the minimum diffusion panel 40 thickness needed to produce satisfactory image illumination results has been found to be substantially one thirty-second of an inch. Nevertheless the present invention is understood to include any minimum primary panel 30 and diffusion panel 40 thicknesses which produces commercially satisfactory illumination of the image sheets 12 and 12A and images I and IA.

In its most basic form, one image sheet 12 is mounted over the primary panel first face 32, but a second image sheet 12A is not mounted over the primary panel second face 34 because the at least one groove 36 would be visible through the second image sheet 12A and would clutter and distort the second image IA. For this reason, the diffusing panel 40 is provided, which is a key inventive feature of the present apparatus 10 and has been found to diffuse light radiated through the at least one groove 36 in the primary panel second face 34 so that the groove 36 is not noticeable during illumination and a second image sheet 12A can be mounted on a second side of panel assembly 20. In this way, the capabilities of the display apparatus 10 are effectively doubled through displaying two opposing images I and IA rather than just one.

The cover sheet structure 50 serves the dual purposes of structurally holding together the upper ends of the primary panel 30, diffusing panel 40 and image sheets 12 and 12A so that gravity does not bow and fan them apart over time, and of protecting the image sheets 12 and 12A from mechanical damage and staining, particularly in restaurant and bar environments.

Display apparatus 10 can function as long as primary panel 30, diffusing panel 40, image sheets 12 and 12A and cover sheet structure 50 are translucent even if they are cloudy, colored or frosted, it is generally preferred that all be clear and transparent, except for images I and IA which typically are translucent and colored and in limited circumstances might have opaque portions. The cover sheet structure 50 in particular is preferably transparent so that it does not alter or reduce the visibility of illuminated images I and IA.

In addition, although panel assembly 20 is in most instances generally planar, and can be generally square or rectangle, tall and narrow, short and long or curved along its edge or edges. The panel assembly 20 alternatively is contemplated to be curved across its face and any desired configuration.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A light panel display apparatus, comprising:

an upright panel assembly comprising a primary panel having a substantially smooth primary panel first face, and a primary panel second face with at least one light distributing irregularity;

a diffusing panel, having substantially smooth diffusing panel inward face and substantially smooth a diffusing panel outward face, said diffusing panel being positioned substantially parallel and adjacent to and in abutting relation with the primary panel second face; a translucent first image sheet having a first image and positioned substantially parallel to and abutting said primary panel first face and a translucent second image sheet having a second image and positioned substantially parallel to and abutting said diffusing panel outward face;

a cover sheet structure for structurally holding together upper ends of said primary panel, diffusing panel and image sheets such that they are held in abutting contact and gravity does not bow and fan them apart over time and for protecting said image sheets from mechanical damage and staining, said cover sheet structure having generally an inverted U-shape with a first cover sheet section extending over said first image sheet, and a second cover sheet section extending over said second image sheet, and a cover sheet connecting portion connecting to said first cover sheet-section at a first corner fold and connecting-to said second cover sheet section at a second corner fold, thereby spacing said first cover sheet section from said second cover, sheet section a distance substantially matching the combined width of panels and image sheets to be contained within said cover sheet structure, the panel assembly having a -panel assembly upper end and a panel assembly lower end;

wherein said primary panel, said diffusing panel, said first cover sheet section and said second cover sheet section are one of translucent and transparent; and a base assembly comprising a generally horizontally extending base member with an upwardly opening panel assembly receiving slot into which said panel assembly lower end is removably fitted such that said panel assembly is retained in an upright position, a lighting circuit comprising a light source positioned and oriented to radiate light into an edge of said panel assembly of sufficient intensity to illuminate said panel assembly, and an electric power source.

2. The apparatus of claim 1, wherein said slot comprises an internal engaging recess and wherein at least one of said cover sheet sections comprises an outwardly protruding engaging bulge for releasable snap engagement into said engaging recess to releasably secure said panel assembly into said panel assembly receiving slot.

3. The apparatus of claim 1. wherein said lighting circuit comprises an off/on switch.

4. The apparatus of claim 1, wherein said light source comprises a series of light emitting diodes distributed within said panel assembly receiving slot and joined together as part of a light emitting diode bar.

5. The apparatus of claim 4, wherein said base member comprises a housing containing a base member chamber and having a housing bottom wall with a battery access door, an inwardly beveled housing front wall and an inwardly beveled housing back wall, both for mounting and displaying visible indicia, upright housing side walls, a, housing top wall and upright slot walls bordering and defining the panel assembly receiving slot such that said assembly receiving slot has a depth sufficient to retain the light emitting diode bar and also receive and securely mount said panel assembly lower end.

6. The apparatus of claim 5, wherein said base member chamber is bifurcated into a a power chamber for retaining batteries and accessible through said battery access door, and a circuit chamber for containing circuit wiring and elements.

7. The apparatus of claim 4, wherein said lighting circuit comprises an off/on switch and said housing comprises a housing top wall, wherein said light emitting diode bar is retained within said assembly receiving slot and above the base member chamber, and a light circuit wire extends downwardly through said housing top wall from said light emitting diode bar to said on/off switch to and from there to said power source.

8. The apparatus of claim 1. wherein said base member is hollow to define an internal chamber containing said lighting circuit, and said power source comprises a battery.

9. The apparatus of claim 1, wherein said at least one light distributing irregularity comprises at least one light distributing groove.

10. The apparatus of claim 9, wherein said primary panel second face has a lower end and an upper end, and wherein said at least one light distributing groove comprises a series of substantially horizontal light distributing grooves extending generally from the lower end to the upper end of said primary panel second face for redistributing light intensity evenly throughout said primary panel to fully illuminate said images.

11. The apparatus of claim 10, wherein said light distributing grooves in said series become progressively closer from the lower end to the upper end of said primary panel second face to more evenly distribute light intensity throughout said primary panel.

12. The apparatus of claim 1, wherein said primary panel has a minimum thickness of substantially one sixteenth inch.

13. The apparatus of claim 1, wherein said diffusing panel has a minimum thickness of substantially one thirty-second inch.

14. The apparatus of claim 1, wherein said cover sheet is transparent to maximize the visibility of said first image and said second image.

15. The apparatus of claim 14, wherein said first image sheet is positioned substantially parallel and adjacent to said primary panel first face, and additionally comprising a second image sheet having a second image and being substantially parallel and adjacent to said diffusing panel outward face.

16. A light panel display apparatus, comprising:

an upright panel assembly comprising a primary panel having a substantially smooth primary panel first face and a primary panel second face with at least one light distributing irregularity;

a diffusing panel, having substantially smooth diffusing panel inward face and substantially smooth a diffusing panel outward face, said diffusing panel being positioned substantially parallel and adjacent to with said primary panel second face; a translucent first image sheet having a first image and positioned substantially parallel and adjacent to said primary panel first face and a translucent second image sheet having a second image and being substantially parallel and adjacent to said diffusing panel outward face;

a cover sheet structure for structurally holding together upper ends of said primary panel, diffusing panel and image sheets such that they are held in abutting contact and gravity does not bow and fan them apart over time and for protecting said image sheets from mechanical damage and staining, said cover sheet structure having generally an inverted U-shape with a first cover sheet section extending over said first image sheet and a second cover sheet section extending over said second image sheet, and a cover sheet connecting portion connecting to said first cover sheet section at a first corner fold and connecting to said second cover sheet section at a second corner fold, thereby spacing said being sized to space 'said first cover sheet section from said second cover sheet section a distance substantially matching the combined width of panels and image sheets to be contained within said cover sheet structure, the panel assembly having a panel assembly upper end and a panel assembly lower end; wherein said primary panel, said diffusing panel, 'said first cover sheet section and said second cover sheet section are one of translucent and transparent; and a base assembly comprising a generally horizontally extending base member with a panel assembly receiving slot into which said panel assembly is removably fitted such that said panel assembly is retained in, a lighting circuit comprising a light source positioned and oriented to radiate light into an edge of said panel assembly of sufficient intensity to illuminate said panel assembly, and an electric power source.

17. The apparatus of claim 16, wherein said slot comprises an internal engaging recess and wherein at least one of said cover sheet sections comprises an outwardly protruding engaging bulge for releasable snap engagement into said engaging recess to releasably secure said panel assembly into said panel assembly receiving slot.

* * * * *